US007367731B2

(12) United States Patent
Kaneta et al.

(10) Patent No.: US 7,367,731 B2
(45) Date of Patent: May 6, 2008

(54) FEEDING ACCURACY ADJUSTMENT APPARATUS, RECORDING APPARATUS, LIQUID EJECTING APPARATUS, FEEDING ACCURACY ADJUSTMENT METHOD FOR RECORDING MEDIUM

(75) Inventors: Satoshi Kaneta, Nagano-ken (JP); Mamoru Ukita, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 81 days.

(21) Appl. No.: 10/956,298

(22) Filed: Oct. 1, 2004

(65) Prior Publication Data

US 2005/0084313 A1 Apr. 21, 2005

(30) Foreign Application Priority Data

Oct. 2, 2003 (JP) ..... 2003-344952

(51) Int. Cl.
*B65H 7/00* (2006.01)

(52) U.S. Cl. ..... 400/582; 400/636.1; 271/10.01; 271/109; 347/16; 347/104

(58) Field of Classification Search ..... 400/582, 400/578; 347/5, 6, 40, 19, 12, 14, 9, 41; 271/10.01, 109, 3.14; 101/118, 232
See application file for complete search history.

(56) References Cited

U.S. PATENT DOCUMENTS 5,076,567 A * 12/1991 Sasaki et al. ..... 271/265.02
5,696,542 A * 12/1997 Matsubara et al. ..... 347/12
5,743,661 A * 4/1998 Tamura ..... 400/55
5,793,177 A * 8/1998 Chia ..... 318/685
5,828,387 A * 10/1998 Wataya et al. ..... 347/14
5,838,465 A * 11/1998 Satou et al. ..... 358/520
5,988,790 A * 11/1999 Koike et al. ..... 347/41
6,101,426 A * 8/2000 Kimura et al. ..... 700/219
6,116,795 A * 9/2000 Ogasawara ..... 400/582
6,158,344 A * 12/2000 Walker et al. ..... 101/484
6,158,841 A * 12/2000 Kakutani ..... 347/40
6,454,474 B1 * 9/2002 Lesniak et al. ..... 400/582
6,830,399 B2 * 12/2004 Adkins et al. ..... 400/582
6,857,736 B2 * 2/2005 Onishi et al. ..... 347/105
2002/0044290 A1 4/2002 Otsuki ..... 358/1.5

FOREIGN PATENT DOCUMENTS

JP 62-119075 * 11/1985
JP 408026582 A * 1/1996
JP 2000108431 * 4/2000
JP 2002-120421 4/2002

* cited by examiner

*Primary Examiner*—Jill E. Culler
(74) *Attorney, Agent, or Firm*—John J. Penny, Jr.; Edwards Angell Palmer & Dodge LLP

(57) ABSTRACT

The printer 1 includes a controller 32 for feeding at least a sort of recording medium P to a feed mechanism, obtaining a tendency of degradation of feed accuracy with respect to at least one sort of the recording medium, calculating an adjustment value of feed accuracy based on the number of the recording medium in the past, based on the tendency, and adjusting a feed accuracy based on the calculated adjustment value.

35 Claims, 4 Drawing Sheets

2000 PAPERS

| SIZE \ MEDIUM | A | B | C |
|---|---|---|---|
| a | $n_1$ | $n_2$ | $n_3$ |
| b | $n_4$ | $n_5$ | $n_6$ |
| c | $n_7$ | $n_8$ | $n_9$ |

FIG. 4

| SIZE \ MEDIUM | A | B | C |
|---|---|---|---|
| a | $m_1$ | $m_2$ | $m_3$ |
| b | $m_4$ | $m_5$ | $m_6$ |
| c | $m_7$ | $m_8$ | $m_9$ |

FIG. 5

FEEDING ACCURACY ADJUSTMENT APPARATUS, RECORDING APPARATUS, LIQUID EJECTING APPARATUS, FEEDING ACCURACY ADJUSTMENT METHOD FOR RECORDING MEDIUM

This patent application claims a priority from Japanese Patent Application No. 2003-344952 filed on Oct. 2, 2003, the contents of which are incorporated herein by reference.

BACKGROUND OF THE INVENTION

1. Field of the Invention

The present invention relates to a recording apparatus including a feed accuracy adjustment apparatus. More particularly, the preset invention relates to a liquid ejecting apparatus such as an ink-jet type recording apparatus by ejecting liquid, for example ink, to ejected medium from the ink-jet type recording head.

Here, the liquid ejecting apparatus includes a printer, a copying machine or a facsimile which performs recording by injecting ink from the recording head onto the recording medium using an ink-jet type recording head, as well as any apparatus which makes the liquid to be adhered onto an exposed media corresponding to the recording medium by injecting any type of liquid suitable for a predetermined purpose instead of the ink from a liquid injection head corresponding to the ink-jet type recording head.

Other than the above-mentioned recording head, the liquid injection head includes a coloring-material injection head used for color filter manufacturing such as a liquid crystal display, an electrode material (conductive paste) injection head used for electrode formation of an organic EL display, a field emission display (FED), etc., and an organic substance injection head used for biochip manufacture, a specimen injection head as a precision pipette, and the like.

2. Description of the Related Art

A feed apparatus for feeding recording medium in a recording medium such as an ink-jet type printer, generally includes a feed paper drive roller (so-called a feed roller), and a feed paper driven roller. The feed apparatus feeds the recording medium to the recording mechanism via these rollers and executes an accurate transporting and an accurate recording. Recently, there are some papers that are required to record more accurately, for example a PM photo paper (a name of commodity of Seiko Epson Corporation), and consequently, it becomes important to control the feed accuracy when feeding the recording medium.

In a conventional method for controlling the feed accuracy, an average feed error with respect to plural recording medium is obtained in every sort of the recording medium, and then, a correction for feeding is respectively executed in a direction so that the average error approaches to zero as disclosed, for example, in Japanese Patent Application Publication (Laid-Open) No. 2002-120421. Here, an actual feed error varies according to the increase of the number of the transported recording medium, when starting to use a new feed apparatus. However, this variation is not taken into consideration in the conventional method. Thus, a correction corresponding to the actual feed error is not executed, and consequently, it is impossible to keep the feed accuracy of the recording medium optimal constantly.

The present inventors found the fact that although the feed error increases according to the number of the recording medium, after feeding of a certain number of the recording medium, the increasing amount of the feed error is approximately zero, and consequently the feed error becomes a constant value, by feeding some sorts of plural the recording medium to the feed mechanism experimentally.

SUMMARY OF THE INVENTION

The present invention is based on this knowledge as described above, and an object of the present invention is to provide an apparatus and a feed accuracy correcting method of recording medium, for calculating a correction value in advance based on the number of the recording medium that is fed to the feed mechanism, and next, correcting the feed error.

To achieve such objects, according to the first aspect of the present invention, a feed accuracy adjustment apparatus for feeding a recording medium, includes a controller for feeding at least a sort of recording medium to a feed mechanism, obtaining a tendency of degradation of feed accuracy with respect to at least one sort of the recording medium, calculating an adjustment value of feed accuracy based on the number of the recording medium in the past based on the tendency, and adjusting a feed accuracy based on the calculated adjustment value.

Accordingly, although the feed error increases according to the number of the recording medium that is fed to the feed mechanism in past times, this feed error is corrected by a correction value in accordance with its increasing. Consequently, the high qualify printing is constantly possible when using high quality required recording medium such as a PM photo paper.

According to the second aspect of the present invention, the controller may store each of saturation numbers of the recording medium with respect to each of saturations the degradation of feed accuracy, and keeps the feed accuracy a constant value that has been adjusted finally, after the number of the recording medium has reached to the saturating number.

According to the experiments, the feed error does not increase since the certain number of the recording medium has been fed. Since this certain number of the recording medium in which the feed error does not increase is stored in advance, and the feed error is corrected by a correction value that is fixed finally corresponding to the certain number of the recording medium, when feeding further following recording medium, it is not necessary to calculate correction values corresponding to the each number of the recording medium before the feed error becomes constant. Therefore, the correction can be done easily.

According to the third aspect of the present invention, the saturation number may be from 3000 to less than 5000, and the calculating is executed under this condition. According to the inventors' experiments, it becomes clear that the tendency of the degradation of feed accuracy saturates at the number of the recording medium from 3000 to less than 5000. Thus, it is significant to control by using the number mentioned above, to keep the feed accuracy.

According to the fourth aspect of the present invention, the controller may calculate each of the adjustment values, assuming that the tendency of the degradation of feed accuracy is linear. Accordingly, it is possible to calculate the adjustment value of feed accuracy easlily.

According to the fifth aspect of the present invention, the controller may adjust a next feed accuracy based on a sort, a size, and the number of the recording medium that has already been fed. Many sorts and sizes of the recording medium are fed in past time, so that it is possible to adjust the feed accuracy more correctly by accumulating the tendency of degradation of the feed accuracy in every fed recording medium.

According to the sixth aspect of the present invention, a feed accuracy adjustment apparatus for feeding a recording medium, includes a controller for feeding a specified recording medium to a feed mechanism, obtaining a tendency of degradation of feed accuracy with respect to the specified recording medium, calculating an adjustment value of feed accuracy based on the number of plural sorts of the recording medium in the past, based on the tendency, and adjusting a feed accuracy based on the calculated adjustment value.

It was found out that the PM photo paper has the largest tendency of degradation of the feed accuracy in some sorts of the recording medium. Thus, when calculating the adjustment value based on the tendency of the degradation of the PM photo paper, the feed accuracy about the other recording medium is adjusted toward a plus direction. In addition, the mentioned adjustment toward the plus direction is permitted because even if the feed accuracy is adjusted toward the plus direction, the picture quality is not so influenced.

According to the seventh aspect of the present invention, a weighed factor corresponding to a combination of a sort and a size with respect to a predetermined specified number of the recording medium may be further multiplied when the controller calculates the adjustment value of feed accuracy based on the number of the recording medium in the past. Accordingly, since the sorts and sizes of the present recording medium are taken into the consideration, it is possible to adjust the feed accuracy more correctly.

According to the eighth aspect of the present invention, a recording apparatus includes any one of the feed accuracy adjustment apparatus of the aspects in the first to the seventh. Accordingly, the high qualify printing is constantly possible when using high quality required recording medium such as a PM photo paper.

According to the ninth aspect of the present invention, a feed accuracy adjustment apparatus for feeding a ejected medium, includes a controller for feeding at least a sort of ejected medium to a feed mechanism, obtaining a tendency of degradation of feed accuracy with respect to at least a sort of the ejected medium, calculating an adjustment value of feed accuracy based on the number of the ejected medium in the past, based on the tendency, and adjusting a feed accuracy based on the calculated adjustment value.

According to the tenth aspect of the present invention, a liquid ejecting apparatus includes the feed accuracy adjustment apparatus in the ninth aspect.

According to the eleventh aspect of the present invention, a feed accuracy adjustment method for a recording medium, includes steps of feeding at least a sort of recording medium to a feed mechanism and obtaining a tendency of degradation of feed accuracy with respect to at least a sort of the recording medium by, calculating an adjustment value of feed accuracy based on the number of the recording medium in the past based on the tendency; and adjusting a feed accuracy based on the calculated adjustment value.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

BRIEF DESCRIPTION OF THE DRAWINGS

FIG. 4 is a table showing each of weighted factors corresponding to three sorts and three sizes of recording medium.

FIG. 5 is a table showing each of medium sort factors corresponding to three sorts and three sizes of recording medium.

DETAILED DESCRIPTION OF THE INVENTION

Figure 1:
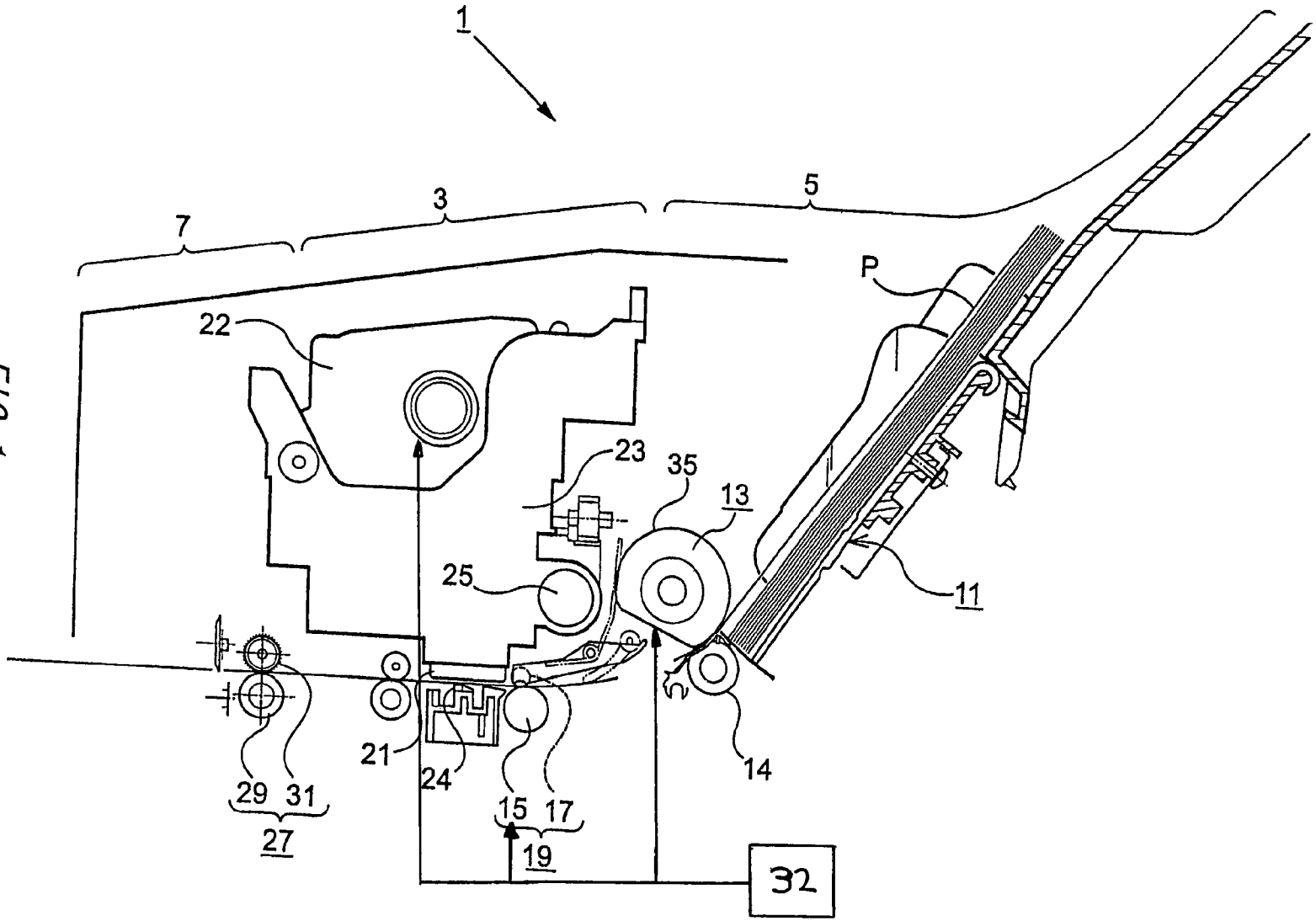
FIG. 1 is a side view showing an ink-jet type printer 1 according to the present invention.
Figure 2:
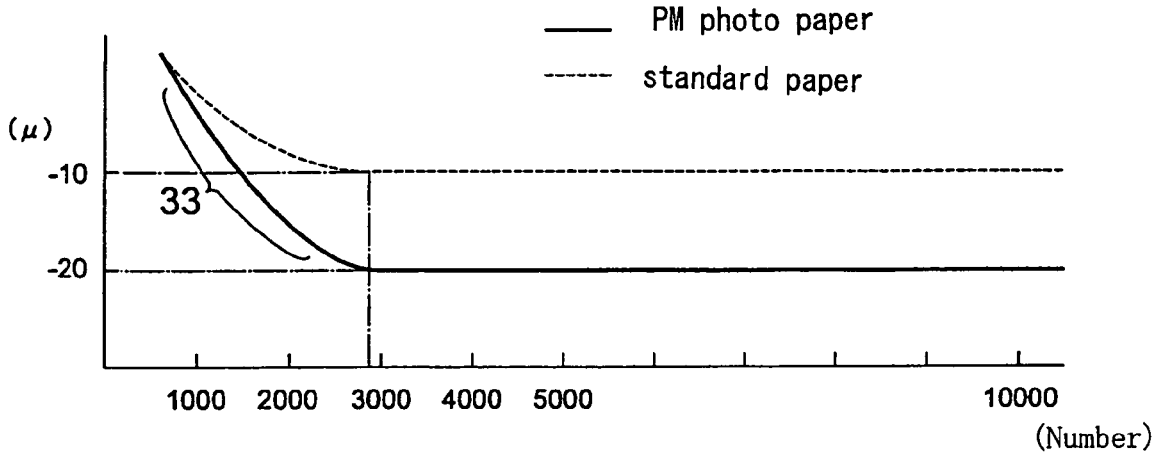
FIG. 2 is a diagram showing a tendency of degradation of feed accuracy of the recording medium.
Figure 3:
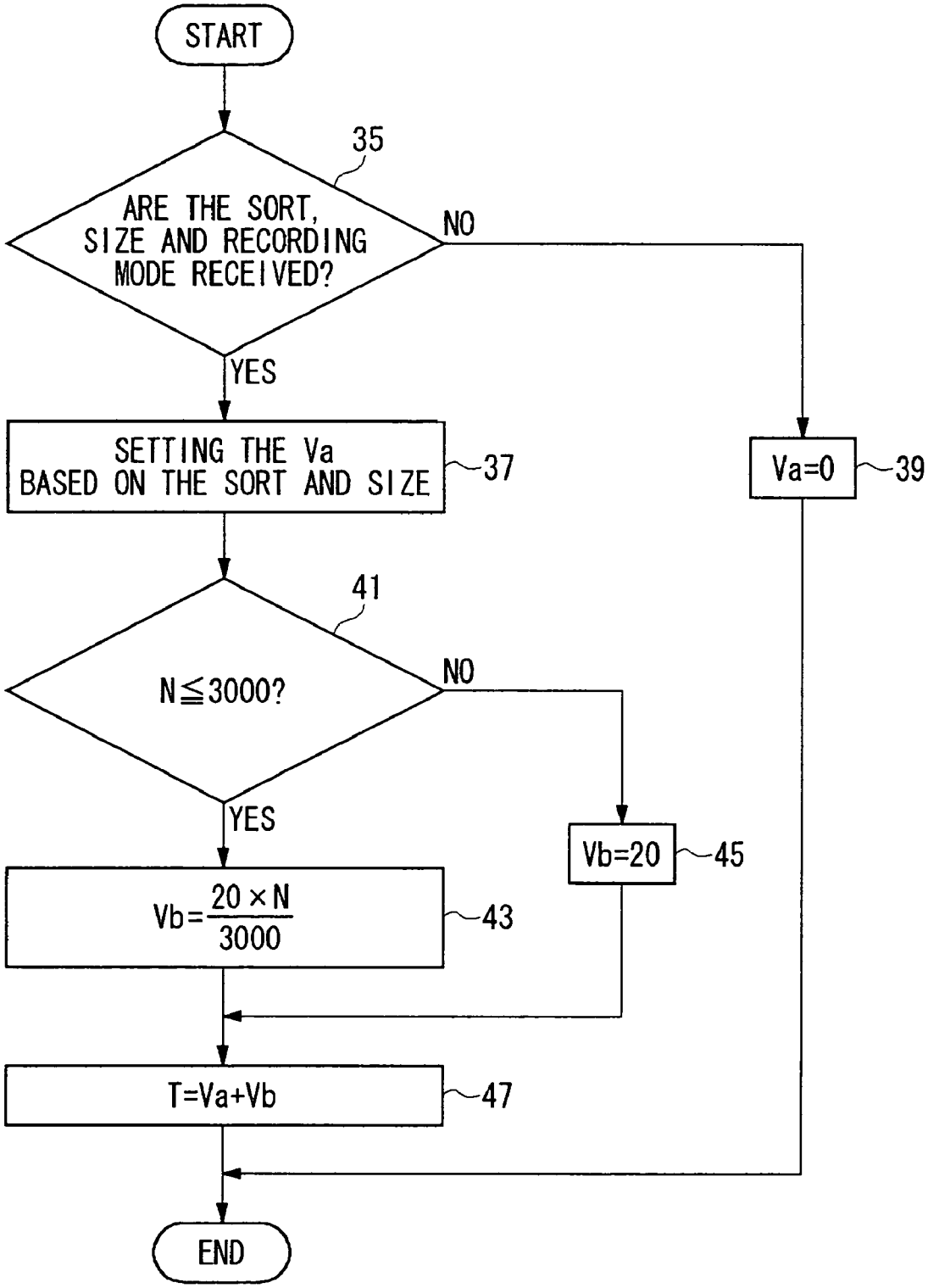
FIG. 3 is a flowchart showing an adjustment of the feed accuracy when feeding the recording medium.

An embodiment according to the present invention will be explained with reference to the drawings. FIG. 1 is a side view showing an ink-jet type printer 1 as an exemplary of a recording apparatus or a liquid ejecting apparatus including a feed accuracy adjustment apparatus for recording medium according to the present invention. Hereinafter, the ink-jet type printer 1 is called the "printer 1" simply. FIG. 2 is a diagram showing a tendency of degradation of feed accuracy of the recording medium. FIG. 3 is a flowchart of an adjustment of the feed accuracy of the recording medium. FIG. 4 is a table showing each of weighted factors corresponding to three sorts and three sizes of recording medium. FIG. 5 is a table showing each of medium sort factors corresponding to three sorts and three sizes of recording medium.

The printer 1 includes a printer body 3, a feed part 5 provided on a rear top part of the printer body 3, and a outputting part 7 provided on a front of the printer body 3. A feed tray 11 is formed in the feed part 5 so that a plurality of recording medium P is stacked on the feed tray 11. A feed roller 13 is provided at a just downstream side of the feed tray 11. The feed roller 13 pushes a top medium of the recording medium toward a separation roller 14 to be sandwiched between the feed roller 13 and the separation roller 14, thereby transporting the top medium forward.

The transported recording medium P reaches to a transport roller 19 including a lower transport driving roller 15 and an upper transport driven roller 17, and then the recording medium P is fed to a recording head 21 located at a downstream side of the transport roller 19, in association with accurate feeding movements in the recording steps by the drive system. In addition, the mechanism in which the recording medium is passed through and fed by the feed roller 13 and the transport roller 19 is called "feed mechanism".

The recording head 21 is supported on a carriage 23, and a plurality of ink cartridges 22 is mounted on the carriage 23. The carriage 23 is constructed to be movable forward and backward along a shaft 25 in a direction perpendicular to the feed direction, i.e. along a scanning direction. A platen 24 is located opposed to the recording head 21. When the recording head 21 prints one side of the recording medium, the recording head 21 performs to support the other side of recording medium P.

A distance between the recording head 21 and the platen 24, i.e. the paper gap, is adjustable since carriage 23 is movable upward and downward according to the thickness of the recording medium P, and the carriage 23 supports the recording head 21. In a state in which the paper gap is adjusted appropriately, the recording medium P passes smoothly on the platen 24, and is recorded in high quality. The recording medium P recorded by the recording head 21 is output from an ejection roller 27 provided at the outputting part 7 sequentially. The ejection roller 27 is includes a lower ejection driving roller 29 and an upper ejection toothed roller 31, and constructed so that the recording medium P is output in association with the rotational driving of the ejection driving roller 29.

Next, the features according to the present invention will be explained. At first, some sorts of recording medium are passed through the feed mechanism as a subject of adjustment of feed accuracy by thousand number in each of the recording medium, and then, how each of the feed accuracies changes in accordance with the increasing of the number of the fed recording medium. FIG. 2 is a diagram showing each of the tendencies of the degradations of standard papers and PM photo papers, when 10000 papers are fed respectively to the feed mechanism in the experiments. An axis of ordinate shows the feed accuracy by the micrometer. As apparent from the diagram, each of the degradations becomes constant when the 3000 papers to 5000 papers are fed, i.e. each of the feeding accuracy saturates. In addition, according to the experiments, it is found that the tendency as described above is similar to the others recording mediums in spite of the sort of the paper, not restricted to the PM photo paper and the standard paper.

In addition, it is found that when feeding the PM photo paper, the degradation of the feed accuracy is most remarkable. It is also found that the feed accuracy descends about 20μ when 3000 papers to 5000 papers are fed, and after that, the feed accuracy does not descend.

In terms of the tendency of the degradation of the feed accuracy of the recording medium as described above, a controller 32 is provided for calculating an adjustment value of the feed accuracy based on the number of the recording medium in the past, and adjusting the feed accuracy of the recording medium as shown in the flowchart in FIG. 3.

As shown in FIG. 2, the degradation of the feed accuracy of the PM photo paper is regarded that the feed accuracy decreases linearly until 3000 papers, i.e. in a region shown the symbol 33 in FIG. 2, and that the feed accuracy becomes constant to be about 20μ after 3000 papers have been fed. Under this assumption, the degradation of the feed accuracy $V_b$ is calculated by the following Equation (1).

$$V_b=(20\times N)\div 3000 \quad (1)$$

where N represent the number of the fed papers (i.e. counter values). Once the N (counter values) exceeds 3000, the value of the $V_b$ becomes constant, i.e., $V_b$=20μ. In addition, an approximated curve more correctly corresponding to the region 33 may be obtained and then the $V_b$ may be calculated more correctly based on this approximated curve.

In the flowchart shown in FIG. 3, the controller 32 decides whether the controller 32 receives a sort and size of the recording medium that is to be fed, and a recording mode. The sort and size of the recording medium and the recording mode are set by a user in a step 35. In this step, if the controller 32 decides that the sort of the recording medium is such a sort, for example a PM photo paper, a super fine paper, and a standard paper, to be recorded through the feed mechanism, the operating of this flowchart goes to "YES" and then, in the step 37, the controller 32 sets the sort of the recording medium and also sets the correcting value $V_a$ based on the size. In addition, as described above, varying the correction values according to the sort of the recording medium and adjusting the feed accuracy of the following recording medium is conventionally done. In the step 35, if the controller 32 decides that the sort of the recording medium is such a sort, for example a CD-ROM and a thick paper, to be recorded not passing through the feed mechanism, the operating of this flowchart goes to "NO" and then in the step 39 the controller 32 sets the correcting value $V_a$ equal to zero. Then, the operating of this flowchart finishes.

Next, in the step 41, the controller 32 decides whether the count values representing the number of the fed papers is equal to or less than 3000. If the count value is equal to or less than 3000, the operating of this flowchart goes to "YES", and in the step 43, the controller 32 calculates the degradation of the feed accuracy $V_b$ according to the equation (1). The value $V_b$ represents a degree of the degradation of the feed accuracy according to the number of the fed recording medium in the past. In the step 41, if the count value is larger than 3000, i.e. over 3000 papers has already fed, the operating of this flowchart goes to "NO" and in the step 45 the controller 32 sets the correcting value $V_b$ to be 20μ, i.e. $V_b$=20μ. As described above, this operation is based on the assumption that the degradation of the feed accuracy becomes constant, i.e. $V_b$=20μ when the number of the fed recording medium exceeds 3000.

Next, in the step 47, the whole correction value T is calculated by the following Equation (2)

$$T=V_a+V_b \quad (2)$$

where the correcting value $V_a$ is based on the sort and size of the recording medium as described above, and the degradation of the feed accuracy $V_b$ descend according to the number of the fed recording medium in the past. Therefore, the controller 32 output signals to the drive system of the transport roller 19 to adjust the feed accuracy based on the adjustment value.

In the operation of the flowchart in FIG. 3, the adjustment value is calculated based on the data of the PM photo paper, where the tendency of the degradation is most remarkable. Therefore, the feed accuracies of the others recording medium are adjusted toward a plus direction. In addition, the mentioned adjustment toward the plus direction is permitted because the picture quality is not so influenced even if the feed accuracy is adjusted toward the plus direction.

In this example, as described above, a degradation data of the feed accuracy according to a specified recording medium, i.e. the PM photo paper is used when adjusting the feed accuracies of the others sorts of recording medium. Alternatively, for example, weighted factors corresponding to the sorts and sizes of others recording medium may be calculated in advance in every 1000 papers, and then each of the mentioned factor is multiplied by each of the results of the equation (1), so that each of the adjustment values of the feed accuracies with respect to each of the recording mediums may be strictly adjusted.

For example, FIG. 4 is a table showing weighted factors ($n_1$ to $n_9$) when 2000 papers are fed, corresponding to the three sorts of the recording medium (mediums A, B and C) and three sizes of each of the recording mediums (sizes a, b, and c), and the sort of this medium is not the PM photo paper. Although not showing, three tables of the weighted factors corresponding to the mentioned mediums when 0 paper, 1000 papers, and 3000 papers are fed respectively are prepared. For example, when the count value is from 2000 to less than 3000, and when the recording medium B with size B is fed, the feed accuracy $V_b$ of the recording medium B with size B is given by the following Equation (3), $$V_b=(20\times N\times n_5)\div 3000 \quad \text{Equation (3)}$$

where $n_5$ is a weighted factor of the recording medium B with size B, so that the feed accuracy $V_b$ is strictly adjusted.

In the embodiment described above, the sort of the fed recoding medium in the past is assumed to be PM photo paper, and from then on, the feed accuracy is adjusted. However, the sort of the fed recoding medium in the past is not limited to the PM photo paper. Actually, some sorts of recoding medium are used together. Thus, if some sorts of recoding medium are used together, a medium sort factor decided by the combinations of the sorts and sizes of the recoding medium may be used in place of the equation (1). In this case, the medium sort factor is multiplied by the adjustment values in every paper that has just fed, so that the adjustment value of the feed accuracy may be calculated according to a history of the feeding.

For example, FIG. 5 is a table showing medium sort factors ($m_1$ to $m_9$) corresponding to the three sorts of the recording medium (medium A, medium B and medium C) and three sizes of each of the recording mediums (size a, size b, and size c), and the sort of this medium is not the PM photo paper. For example, when the recording medium B with size b is fed as the first paper, the recording medium A with size c is fed as the second paper, and the recording medium C with size a is fed as the third paper, each of the degradations of the feed accuracies $V_b$ is calculated in each of the feeding according to the following equations (4), (5), and (6).

The first paper $$V_b(1)=(20\div 3000\times m_5)\div 3000 \quad \text{Equation (4)}$$

The second paper $$V_b(2)=V_b(1)+(20\div 3000\times m_7)\div 3000 \quad \text{Equation (5)}$$

The third paper $$V_b(3)=V_b(2)+(20\div 3000\times m_3)\div 3000 \quad \text{Equation (6)}$$

As shown above, the feed accuracy $V_b$ is accumulated, and the controller 32 calculates an adjustment value corresponding to the forth paper is given by the equation (6).

In addition, "(20/3000)" represents a degradation value of the feed accuracy when one PM photo paper is fed. The medium sort factor represents the ratio of a degradation value of the feed accuracy of the PM photo paper to a degradation value of the feed accuracy of the present recording medium. Therefore, when "(20/3000)" is multiplied by the medium sort factor of the present recording medium, a degradation value of the feed accuracy corresponding to the only one recording medium is given. As shown in the equations (4) to (6), when repeating the addition of this value, the accumulated degradation value of the feed accuracy with respect to the recording mediums that have already been fed is obtained.

Accordingly, the adjustment values can be obtained correctly by accumulating the degradation values of the feed accuracy in each of the fed papers as described above. Alternatively, the weighted factor may be multiplied by the mentioned-above accumulated value, therefore, the adjustment values can be obtained more correctly.

Moreover, in this embodiment, the method for obtaining the adjustment value of the feed accuracy is based on the degradation of the PM photo paper, i.e. based on the fact that the feed accuracy of the PM photo paper descends about 20μ when 3000 PM photo papers are fed. Alternatively, another recording medium may be used as a reference in a similar manner as described above. In addition, others methods may be used when calculating the adjustment values of the feed accuracy according to the history of the fed recording medium in the past that pass through the feed mechanism.

According to the present invention, a recording apparatus and a liquid ejecting apparatus for adjusting automatically the adjustment values of the feed accuracy which has a tendency of degradation during the feeding of the recording medium can be provided.

Although the present invention has been described by way of exemplary embodiments, it should be understood that those skilled in the art might make many changes and substitutions without departing from the spirit and the scope of the present invention which is defined only by the appended claims.

What is claimed is:

1. A feed accuracy adjustment apparatus for feeding a recording medium, comprising: a controller for feeding at least a sort of recording medium to a feed mechanism, obtaining a tendency of degradation of feed accuracy with respect to at least one sort of the recording medium, calculating an adjustment value of feed accuracy based on an increase in an amount of recording medium transported through a printing device and based on the tendency, and adjusting a feed accuracy based on the calculated adjustment value, wherein said controller stores a saturation number for each sort of the recording medium with respect to the degradation of feed accuracy, and keeps the feed accuracy to be a constant value after the number of the recording medium has reached the saturation number.

2. The feed accuracy adjustment apparatus as claimed in claim 1, wherein the saturation number is from 3000 to less than 5000, and the calculating is executed under this condition.

3. The feed accuracy adjustment apparatus as claimed in claim 1, wherein said controller calculates each of the adjustment values, assuming that the tendency of the degradation of feed accuracy is linear.

4. The feed accuracy adjustment apparatus as claimed in claim 1, wherein said controller adjusts a next feed accuracy based on a sort, a size, and the number of the recording medium that has already been fed.

5. The feed accuracy adjustment apparatus as claimed in claim 1, wherein a weighted factor corresponding to a combination of a sort and a size with respect to a predetermined specified number of the recording medium is further multiplied when said controller calculates the adjustment value of feed accuracy based on the number of the recording medium in the past.

6. A recording apparatus comprising the feed accuracy adjustment apparatus cited in claim 1.

7. The feed accuracy adjustment apparatus as claimed in claim 1, wherein said controller records the number of the recording medium that has already been fed, with respect to a sort and a size.

8. A feed accuracy adjustment apparatus for feeding a recording medium, comprising: a controller for feeding a specified recording medium to a feed mechanism, obtaining a tendency of degradation of feed accuracy with respect to the specified recording medium, calculating an adjustment value of feed accuracy based on an increase in an amount of recording medium transported through a printing device and based on the tendency, and adjusting a feed accuracy based on the calculated adjustment value, wherein a weighted factor corresponding to a combination of a sort and a size with respect to a predetermined specified number of the recording medium is further multiplied when said controller calculates the adjustment value of feed accuracy based on the number of the recording medium in the past.

9. A recording apparatus comprising the feed accuracy adjustment apparatus cited in claim 8.

10. The feed accuracy adjustment apparatus as claimed in claim 8, wherein said specified recording medium is a paper that has a high tendency for degradation of feed accuracy.

11. The feed accuracy adjustment apparatus as claimed in claim 8, wherein said specified recording medium is a PM photo paper.

12. A feed accuracy adjustment apparatus for feeding a ejected medium, comprising: a controller for feeding at least a sort of ejected medium to a feed mechanism, obtaining a tendency of degradation of feed accuracy with respect to at least a sort of the ejected medium, calculating an adjustment value of feed accuracy based on an increase in an amount of recording medium transported through a printing device and based on the tendency, and adjusting a feed accuracy based on the calculated adjustment value, wherein said controller stores a saturation number for each sort of the recording medium with respect to the degradation of feed accuracy, and keeps the feed accuracy at a constant value after the number of the recording medium has reached the saturation number.

13. A liquid ejecting apparatus comprising the feed accuracy adjustment apparatus cited in claim 12.

14. A feed accuracy adjustment method for a recording medium, comprising steps of:

feeding at least a sort of recording medium to a feed mechanism and obtaining a tendency of degradation of feed accuracy with respect to at least a sort of the recording medium;

calculating an adjustment value of feed accuracy based on an increase in an amount of recording medium transported through a printing device and based on the tendency;

adjusting a feed accuracy based on the calculated adjustment value; and storing a saturation number for each sort of the recording medium with respect to the degradation of feed accuracy, and keeping the feed accuracy to be a constant value after the number of the recording medium has reached the saturation number.

15. The method according to claim 14, wherein said calculating step comprises assuming that the tendency of the degradation of feed accuracy is linear.

16. The method according to claim 14, wherein said adjusting step comprises adjusting a next feed accuracy based on a sort, a size, and the number of the recording medium that has already been fed.

17. The method according to claim 14, wherein said calculating step comprises multiplying a weighted factor corresponding to a combination of a sort and a size with respect to a predetermined specified number of the recording medium when said calculating step calculates the adjustment value of feed accuracy based on the number of the recording medium in the past.

18. A feed accuracy adjustment apparatus for feeding a recording medium, comprising: a controller for feeding at least a sort of recording medium to a feed mechanism, obtaining a tendency of degradation of feed accuracy with respect to at least one sort of the recording medium, calculating an adjustment value of feed accuracy based on an increase in an amount of recording medium transported through a printing device and based on the tendency, and adjusting a feed accuracy based on the calculated adjustment value, wherein a weighted factor corresponding to a combination of a sort and a size with respect to a predetermined specified number of the recording medium is further multiplied when said controller calculates the adjustment value of feed accuracy based on the number of the recording medium in the past.

19. The feed accuracy adjustment apparatus as claimed in claim 18, wherein said controller stores a saturation number for each sort of the recording medium with respect to the degradation of feed accuracy, and keeps the feed accuracy to be a constant value after the number of the recording medium has reached the saturation number.

20. The feed accuracy adjustment apparatus as claimed in claim 19, wherein the saturation number is from 3000 to less than 5000, and the calculating is executed under this condition.

21. The feed accuracy adjustment apparatus as claimed in claim 18, wherein said controller calculates each of the adjustment values, assuming that the tendency of the degradation of feed accuracy is linear.

22. The feed accuracy adjustment apparatus as claimed in claim 18, wherein said controller adjusts a next feed accuracy based on a sort, a size, and the number of the recording medium that has already been fed.

23. A recording apparatus comprising the feed accuracy adjustment apparatus cited in claim 18.

24. The feed accuracy adjustment apparatus as claimed in claim 18, wherein said controller records the number of the recording medium that has already been fed, with respect to a sort and a size.

25. A feed accuracy adjustment apparatus for feeding a recording medium comprising:

a controller for obtaining a value of degradation of feed accuracy corresponding to the number of the recording medium in the past and calculating an adjustment value of the feed accuracy based on said obtained value of the tendency of the degradation, wherein said controller adjusts the feed accuracy by using said calculated adjustment value if the number of the recording medium in the past is equal or less than a predetermined number of the recording medium, and said controller adjusts the feed accuracy by using a constant adjustment value if the number of the recording medium in the past is greater than the predetermined number of the recording medium.

26. The feed accuracy adjustment apparatus as claimed in claim 25, wherein a first feed accuracy adjusted by using said calculated adjustment value is substantially equal to a second feed accuracy adjusted by using said constant adjustment value.

27. The feed accuracy adjustment apparatus as claimed in claim 25, wherein said controller obtains said value of a tendency of degradation of feed accuracy based on a tendency of the degradation of the feed accuracy with respect to the number of the recording medium, and uses the adjustment value that has been calculated finally as said constant adjustment value, after the number of the recording medium has reached the saturation number of the recording medium with respect to the saturation of the degradation of feed accuracy.

28. The feed accuracy adjustment apparatus as claimed in claim 27, wherein said predetermined number of the recording medium is the saturation number of the recording medium with respect to saturation of the degradation of the feed accuracy of the recording medium; and said controller stores the saturation number of the recording medium in advance.

29. The feed accuracy adjustment apparatus as claimed in claim 27, wherein the saturation number is between approximately 3000 and approximately 5000.

30. The feed accuracy adjustment apparatus as claimed in claim 27, wherein said controller calculate the adjustment value based upon a linear degradation of feed accuracy.

31. The feed accuracy adjustment apparatus as claimed in claim 25, wherein said controller adjusts a next feed accuracy based on a sort, size and number of the recording medium that has been fed.

32. The feed accuracy adjustment apparatus as claimed in claim 25, wherein a weighted factor corresponding to a combination of a sort and a size with respect to a predetermined number of the recording medium is further multiplied when said controller calculates the adjustment value of feed accuracy based on the number of the recording medium in the past.

33. A feed accuracy adjustment apparatus for feeding a ejected medium, comprising: a controller for feeding at least a sort of ejected medium to a feed mechanism, obtaining a tendency of degradation of feed accuracy with respect to at least a sort of the ejected medium, calculating an adjustment value of feed accuracy based on an increase in an amount of recording medium transported through a printing device and based on the tendency, and adjusting a feed accuracy based on the calculated adjustment value, wherein a weighted factor corresponding to a combination of a sort and a size with respect to a predetermined specified number of the recording medium is further multiplied when said controller calculates the adjustment value of feed accuracy based on the number of the recording medium in the past.

34. A liquid ejecting apparatus comprising the feed accuracy adjustment apparatus cited in claim 33.

35. A feed accuracy adjustment apparatus for feeding a recording medium comprising:

a controller for obtaining a value of degradation of feed accuracy corresponding to the number of the recording medium in the past and calculating an adjustment value of the feed accuracy based on said obtained value of the tendency of the degradation, wherein said controller adjusts the feed accuracy by using said calculated adjustment value if the number of the recording medium in the past is equal or less than a predetermined feeding amount of the recording medium, and said controller adjusts the feed accuracy by using a constant adjustment value if the number of the recording medium in the past is greater than the predetermined feeding amount of the recording medium.

* * * * *